United States Patent [19]

Stirtz et al.

[11] 4,297,796

[45] Nov. 3, 1981

[54] SHOE WITH THREE-DIMENSIONALLY TRANSMITTING SHOCK-ABSORBING MECHANISM

[76] Inventors: Ronald H. Stirtz; Bill Dellinger, both of Eugene, Oreg.

[21] Appl. No.: 59,578

[22] Filed: Jul. 23, 1979

[51] Int. Cl.[3] ..... A43B 13/18; A43B 13/12; A43B 13/04; A43B 21/32

[52] U.S. Cl. ..... 36/28; 36/30 R; 36/32 R; 36/37

[58] Field of Search ..... 36/38, 29, 30 R, 32 R, 36/44, 3 B, 114, 129, 37, 35 R, 9 R; 139/410, 397, DIG. 1; 66/195, 192

[56] References Cited

U.S. PATENT DOCUMENTS

| | | | |
|---|---|---|---|
| 1,197,911 | 9/1916 | Colt | 36/30 R |
| 1,221,632 | 4/1917 | Tysse | 36/28 |
| 1,650,466 | 11/1927 | Righter | 36/32 R |
| 1,845,008 | 2/1932 | Wallace | 36/30 R |
| 1,867,183 | 7/1932 | Simons | 139/DIG. 1 |
| 2,180,924 | 11/1939 | Dunbar | 36/29 X |
| 2,289,180 | 7/1942 | Davis | 36/32 R |
| 2,356,456 | 8/1944 | Garner | 134/397 X |
| 2,599,317 | 6/1952 | Brady | 36/44 |
| 2,992,550 | 7/1961 | Frith, Jr. | 66/195 |
| 2,996,905 | 8/1961 | Scheibe | 66/192 |
| 3,016,631 | 1/1962 | Servin | 36/9 R |
| 3,234,972 | 2/1966 | Koppelman et al. | 139/410 X |
| 3,525,785 | 8/1970 | Fairbanks | 139/DIG. 1 |
| 4,005,532 | 2/1977 | Giese et al. | 36/44 |

FOREIGN PATENT DOCUMENTS

| | | | |
|---|---|---|---|
| 1287476 | 1/1969 | Fed. Rep. of Germany | 36/32 R |
| 186176 | 9/1922 | United Kingdom | 139/DIG. 1 |
| 435821 | 12/1974 | U.S.S.R. | 36/44 |

*Primary Examiner*—James Kee Chi

*Attorney, Agent, or Firm*—Kolisch, Hartwell & Dickinson

[57] ABSTRACT

A shock-absorbing athletic shoe having a foot-cushioning inner sole member to one face in which, and to at least a portion of the rim in which, is bonded an open-mesh web. The web includes elongated, interwoven stretch-resistant strands which are disposed at oblique angles relative to the shoe's long axis. These strands act as force-transmitters with respect to the sole member, and cause a localized foot-produced deformation in the member to be "distributed" to other regions in the member.

3 Claims, 4 Drawing Figures

SHOE WITH THREE-DIMENSIONALLY TRANSMITTING SHOCK-ABSORBING MECHANISM

BACKGROUND AND SUMMARY OF THE INVENTION

The present invention pertains to an article of footwear, and more particularly to an athletic shoe incorporating a special built-in shock-absorbing or shock-distributing mechanism. For the purpose of explanation herein, a preferred embodiment of the invention is described in the setting of an otherwise conventional running shoe, wherein the mechanism of the invention has been found to have particular utility.

Over the years there has been an increasing interest in the sport/pastime of running. Concomitant with this growing interest has been the development of ever-improving shoes designed especially to accommodate runners. The present invention offers yet another special improvement in running-shoe design, and in particular, pertains to a unique shock-absorbing mechanism which works in conjunction with an inner sole member in such a shoe.

Considering the particular form of the invention which is disclosed herein, the same features an open-mesh web including criss-crossing elongated, interwoven strands of a substantially stretch-resistant material, such as nylon. The specific web disclosed has diamond-shaped meshes which are arranged with their long axes substantially paralleling the long axis in the associated shoe. The web is distributed over a surface of the above-mentioned inner sole member, and about a portion of the perimetral rim in the member, and is bonded thereto along the lengths of each of the strands.

With such mechanism incorporated in a shoe, the tendency of a foot impact to produce a pronounced localized deformation, at the point of impact in the sole member, is minimized through three-dimensional force-transmission activities in the strands in the web. More particularly, when such an impact occurs, the strands directly affected at the region of impact "distribute" the localized deformation to other regions in the sole member (surface and rim), whereby a much greater portion of the sole member, than that immediately within the impact area, acts to absorb the shock of impact. A consequence of this three-dimensional action is a significantly greater degree of comfort for the wearer.

Thus, an extremely simple (in a mechanical sense) modification in an otherwise conventional running shoe appreciably improves the shock-absorbing characteristics of the shoe.

Various other features and advantages which are attained by the mechanism of the invention will become more fully apparent as the description which now follows is read in conjunction with the accompanying drawings.

DETAILED DESCRIPTION OF THE INVENTION

Figure 1:
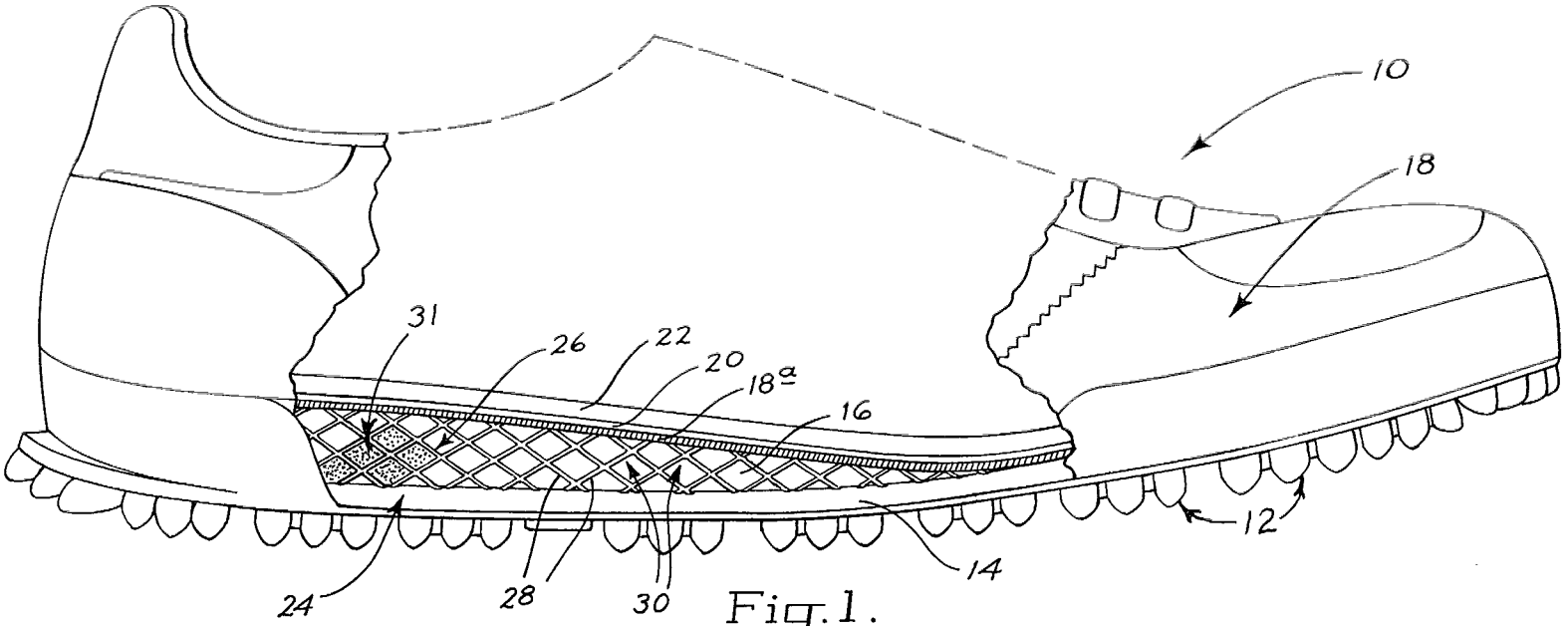
FIG. 1 is a side elevation of a running shoe including shock-absorbing mechanism constructed according to the present invention, with portions of the shoe cut away to reveal details of construction.
Figure 2:
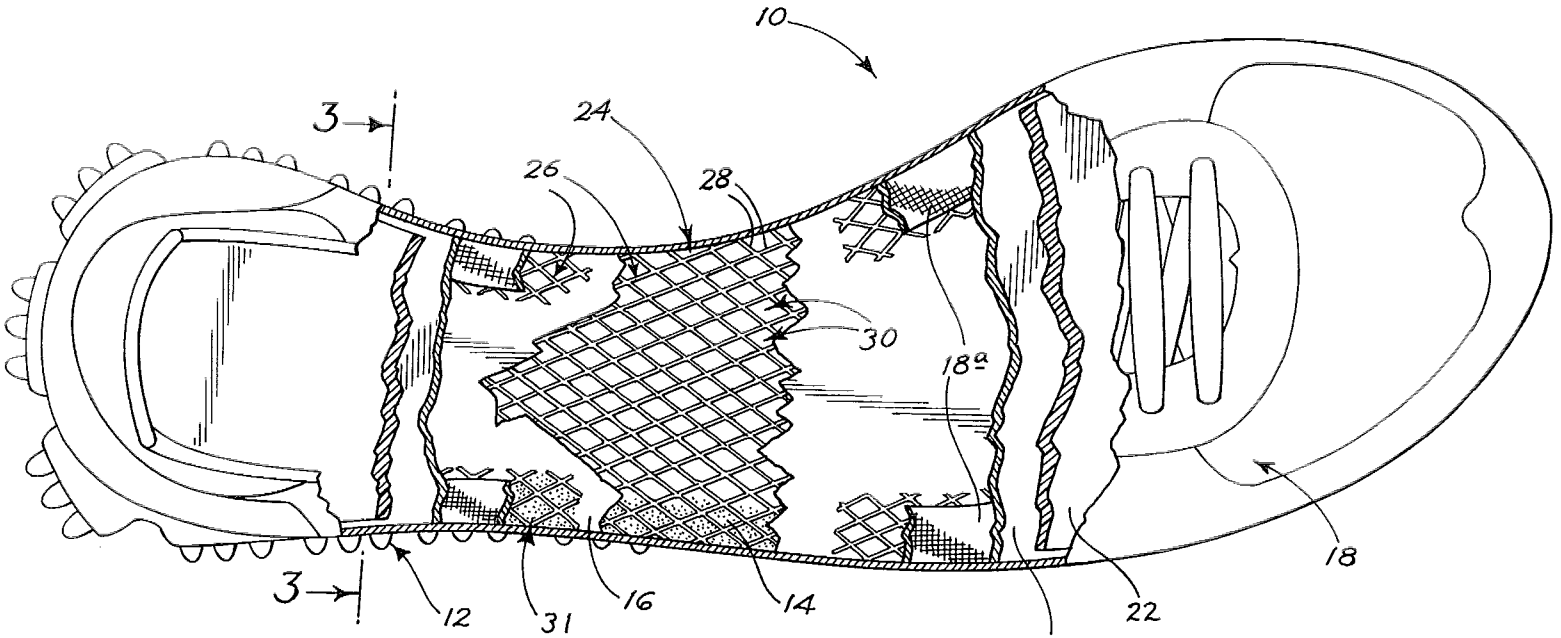
FIG. 2 is a top plan view of the shoe of FIG. 1—again with portions cut away to reveal construction details.
Figure 3:
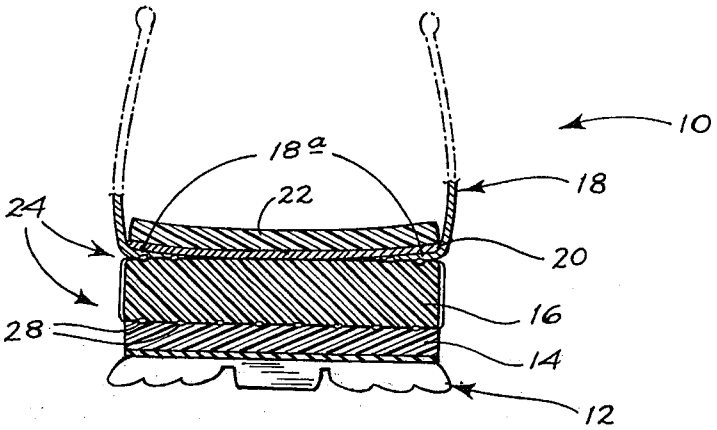
FIG. 3 is a fragmentary cross-sectional view taken generally along the line 3—3 in FIG. 2.

Turning now to the drawings, and first with reference to FIGS. 1–3, inclusive, indicated generally at 10 is a running show which includes shock-absorbing or shock-distributing mechanism constructed in accordance with the present invention. Except with respect to the details of the construction and incorporation of such mechanism, shoe 10 is in all other respects conventional in design. Accordingly, the general construction of shoe 10 is described herein with little elaboration.

Beginning, so to speak, from the bottom of shoe 10, the same includes an outer lugged sole 12 to the top of which is suitably adhered a first inner sole member 14 which is formed of a suitable conventional cushioning material. Adhered on top of member 14 is a second inner sole member 16 which is formed of substantially the same material as member 14. Throughout its length, sole member 14 has a substantially uniform thickness. Sole member 16, on the other hand, tapers from thick near the heel of the shoe to thin near that portion of the shoe which underlies the ball of a wearer's foot. These configurational features are believed to be apparent in FIG. 1. The main body, or the shoe upper, of shoe 10 is shown at 18. The base of body 18, around the perimeter thereof, is in-turned to form a mounting or adhering flange for the body. This flange is designated at 18*a* in the figures. Flange 18*a* sits on top of inner sole member 16 and is suitably adhered thereto. Attached as by gluing on top of sole member 18, and overlying flange 18*a* is a conventional liner 20. Finally, loosely seated on top of liner 20 is the usual inner foot-receiving pad 22.

The shock-absorbing (shock-distributing) mechanism of the present invention is indicated generally at 24. Mechanism 24 herein takes the form of an open mesh nylon web 26 having elongated interwoven and intertied criss-crossing strands, such as strands 28, which define generally diamond-shaped meshes, such as meshes 30 which are arranged with their long axes substantially parallel to the long axis of the shoe. This orientation is believed to be apparent from the views shown in FIGS. 1 and 2. Web 26 extends over the upper surface of lower inner sole member 16 in the space between the confronting contacting faces in members 14, 16, and is stretched and folded, as shown, over rear portions of the perimetral rim in member 16. In the expanse between the confronting faces in the two inner sole members, along the rim side in member 16, and on the top rear perimeter in member 16 the strands are bonded along their respective lengths to these members through the same adhering medium which is used to join the two inner sole members. Such bonding medium is partially represented in FIGS. 1 and 2 by small dots 31.

Figure 4:
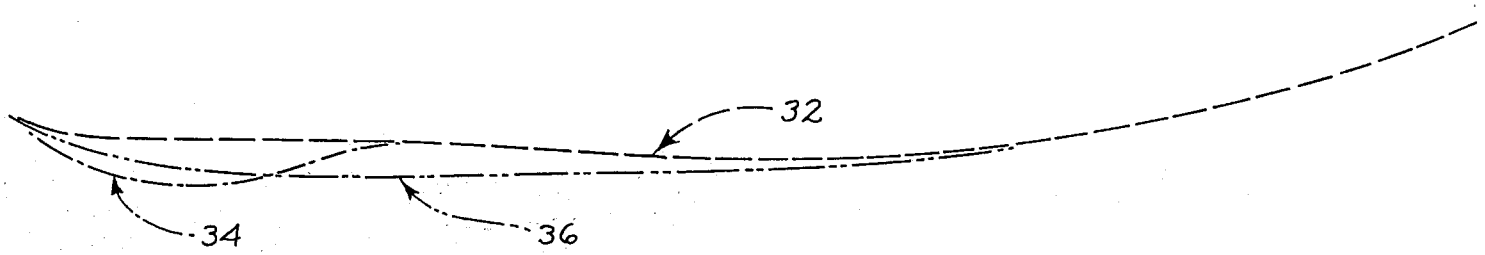
FIG. 4 includes dashed, dash-dot and dash-double-dot lines to illustrate how the mechanism of the invention in the shoe of FIG. 1 performs in comparison with conventional running-shoe performance.

Explaining now how the mechanism of the invention performs in shoe 10, let us now refer particularly to FIG. 4. The dashed line in FIG. 4, such being designated at 32, represents a side profile of the top surface of inner sole member 16 under static or non-impact conditions with the shoe on a wearer's foot. The dash-dot line designated at 34 in FIG. 4 represents, in a somewhat exaggerated way (with respect to vertical scale) how shoe 10 would typically respond to a localized heel impact, in the absence of the incorporation of mechanism 24. In particular, dash-dot line 34 illustrates a relatively pronounced localized deformation in sole members 14, 16, with substantially all of the energy of the impact being absorbed by the material in members 14, 16 immediately below the impact area.

By way of contrast, the dash-double-dot line in FIG. 2, designated 36, generally illustrates the actual performance which occurs in shoe 10 (with mechanism 24 incorporated), with a heel impact occurring like that just mentioned with respect to dash-dot line 34. What happens here is that, on the impact occurring, and "tending" to produce a localized, pronounced deformation, such as that illustrated by line 34, the strands in web 26 which are immediately in and adjacent the impact area tense. As a consequence, and because of the bonds between these strands and the surfaces of members 14, 16, as well as those between the strands and the rim in member 16, the strands transmit forces in a three-dimensional manner to other regions in members 14, 16, whereby the deformation is, so-to-speak, distributed rather than localized. In particular, the tensed strands tend to pull toward the impact area, and in so pulling tend to compress other areas in the inner sole members. Line 36 in FIG. 4, accordingly, illustrates a "distribution" of the deformation resulting from heel impact, and it can be seen that this distribution occurs to numerous, widely spread regions in the inner sole members. Contributing in the distribution of deformation is the construction whereby margins of the shock-distributing web fold over and are bonded to rims in inner sole member 16. This arrangement appreciably enhances the shock-absorbing role played by member 16.

Accordingly, a vastly greater amount of sole material is employed in absorbing the shock of the impact with mechanism 24 performing, as compared with the amount of material which absorbs shock in the absence of mechanism 24.

Thus, a highly shock-absorbing mechanism for a shoe, such as a running shoe, is provided by the present invention. As is apparent from the description hereinabove, and from the drawings, the mechanism of the invention is extremely simple in construction and is easy to incorporate in a shoe during its manufacture.

While a particular type of a strand material with a particular open mesh configuration has been described herein, it is appreciated that variations and modifications are possible. For example, any substantially stretch-resistant material other than nylon may be used. Further, while a web forms a convenient, easy-to-handle structure, individual strands could be installed. Further, while the mechanism of the invention has been described herein as being placed between the confronting faces in a pair of inner sole members (14, 16), it is certainly possible that strand mechanisms like mechanism 24 could be molded with a single inner sole member. Other variations will become apparent to those skilled in the art.

Thus, while a preferred embodiment of the invention has been described herein, and certain variations suggested, it is understood that other changes and variations may be made without departing form the spirit of the invention.

It is claimed and desired to secure by Letters Patent:

1. In an article of footwear including means defining a deformable foot-cushioning inner sole expanse portion bounded by a rim portion which is disposed at an angle relative to said expanse portion, plural elongated stretch-resistant strands distributed over at least a part of said expanse portion and folded over at least a part of said rim portion, and bonding means distributed over said expanse and rim portions producing force-transmission bonds between said portions and said strands along the lengths of the strands, whereby, with a wearer's foot tending to produce a localized deformation in said expanse portion, said strands distribute such deformation to other regions in said expanse portion and to regions in said rim portion through force transmission and distribution via said bonds.

2. In an athletic shoe, a pair of deformable foot-cushioning inner sole members disposed in confronting face-to-face relationship, stretch-resistant elongated strand means distributed between the confronting faces in said members, and folded over the rim of one of said members, and means bonding said strand means to said faces and to said rim, whereby a deformation occurring at one location within said members tends to produce related deformations at other locations therein.

3. In an article of footwear including a deformable foot-cushioning inner sole member having an expanse portion responsive to foot-imparted pressure, and a perimetral rim portion joining said expanse portion at an angle thereto, shock-distributing mechanism comprising strand means including plural, elongated, spaced, substantially linear, stretch-resistant strands distributed at different angles relative to one another over at least a part of said expanse portion, and folded over at least a part of said rim portion and means bonding said strands along their respective lengths to said portions.

* * * * *